US008706005B2

(12) United States Patent
Okabe

(10) Patent No.: US 8,706,005 B2
(45) Date of Patent: Apr. 22, 2014

(54) PROCESS CARTRIDGE AND DEVELOPING CARTRIDGE

(75) Inventor: Yasushi Okabe, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 155 days.

(21) Appl. No.: 13/030,567

(22) Filed: Feb. 18, 2011

(65) Prior Publication Data

US 2011/0206410 A1 Aug. 25, 2011

(30) Foreign Application Priority Data

Feb. 19, 2010 (JP) ..... 2010-034350

(51) Int. Cl.
*G03G 21/18* (2006.01)
*G03G 15/08* (2006.01)

(52) U.S. Cl.
CPC ..... *G03G 21/1817* (2013.01); *G03G 21/1821* (2013.01); *G03G 15/0896* (2013.01); *G03G 2221/1853* (2013.01)
USPC ..... 399/113; 399/119

(58) Field of Classification Search
CPC ..... G03G 21/1817; G03G 21/1821
USPC ..... 399/113, 119
See application file for complete search history.

(56) References Cited

U.S. PATENT DOCUMENTS 6,101,350 A * 8/2000 Suzuki et al. ..... 399/113
6,226,464 B1 * 5/2001 Suwa et al. ..... 399/27
2003/0161654 A1 * 8/2003 Yokomori et al. ..... 399/111
2007/0071481 A1 3/2007 Kamimura et al.
2008/0240774 A1 10/2008 Fukamachi et al.
2008/0310881 A1 * 12/2008 Sato ..... 399/111
2009/0169246 A1 7/2009 Ooyoshi et al.
2009/0169256 A1 * 7/2009 Kamimura et al. ..... 399/119
2009/0175652 A1 7/2009 Kamimura
2009/0226209 A1 9/2009 Shiraki et al.

FOREIGN PATENT DOCUMENTS

JP A-62-192771 8/1987
JP Sho 62-137440 A 8/1987
JP A-2003-316096 11/2003

(Continued)

OTHER PUBLICATIONS

Notification of Reason for Refusal dated Jan. 31, 2012 received from the Japanese Patent Office from related Japanese Application No. 2010-034350, together with an English-language translation.

*Primary Examiner* — Benjamin Schmitt
(74) *Attorney, Agent, or Firm* — Scully, Scott, Murphy & Presser, P.C.

(57) ABSTRACT

A process cartridge that is detachably mounted to a main body of an image forming apparatus, the process cartridge including: an image carrier cartridge that has an image carrier; and a developing cartridge that has a developer carrier. The developing cartridge includes: a driving input part, to which external power for rotating the developer carrier is input, is provided to a first axial end side of the developer carrier; a first supported part; a second supported part; and a third supported part. The image carrier cartridge includes: a first support part arranged on a rotational axis line of the driving input part, a second support part arranged at an image carrier side rather than the rotational axis line of the driving input part; and a third support part arranged at an opposite side to the second support part with the rotational axis line of the driving input part.

16 Claims, 9 Drawing Sheets

(56) References Cited

FOREIGN PATENT DOCUMENTS

| | | |
|---|---|---|
| JP | A-2004-004960 | 1/2004 |
| JP | A-2007-114718 | 5/2007 |
| JP | A-2008-249802 | 10/2008 |
| JP | A-2009-162854 | 7/2009 |
| JP | A-2009-162912 | 7/2009 |
| JP | A-2009-216802 | 9/2009 |

* cited by examiner

PROCESS CARTRIDGE AND DEVELOPING CARTRIDGE

CROSS REFERENCE TO RELATED APPLICATION

The present application claims priority from Japanese Patent Application No. 2010-034350, which was filed on Feb. 19, 2010, the disclosure of which is herein incorporated by reference in its entirety.

TECHNICAL FIELD

The present invention relates to a process cartridge including an image carrier cartridge having an image carrier on which an electrostatic latent image is formed and a developing cartridge having a developer carrier that is rotated so as to supply developer to the electrostatic latent image on the image carrier.

BACKGROUND

A related art process cartridge has been known which includes an image carrier cartridge having a photosensitive drum (image carrier), a developing cartridge having a developing roller (developer carrier) and an image forming unit case to which the image carrier cartridge and the developing cartridge are detachably mounted. According to this technology, the image forming unit case is provided therein with three rollers that support the developing cartridge and a press member that presses the developing cartridge so as to depress the developing roller to the photosensitive drum.

In addition, the developing cartridge is provided with a driving input part to which external power for rotating the developing roller is input. Two of the three rollers are arranged at a photosensitive drum side rather than a rotational axis line of the driving input part and the other one roller is arranged at an opposite side to the two rollers with the rotational axis line being interposed therebetween.

SUMMARY

However, according to the above described related art, when the external power is applied to the driving input part, moment is applied to the developing cartridge about the rotational axis line of the driving input part. Thus, it is necessary to support the developing cartridge so as to favorably receive the moment. However, when support parts to which the moment is applied are set at the same position as the three rollers, the number of the support parts to which the moment is applied is different each other about the rotational axis line, so that it is difficult to expect force that will be applied to the respective support parts.

When it is difficult to expect force that will be applied to the respective support parts, it is not possible to know frictional force that will be generated at the respective support parts. Accordingly, it is difficult to set pressing force of the press member that presses the developing cartridge toward the photosensitive drum.

Accordingly, an object of the invention is to provide a process cartridge in which it is easy to set pressing force of a press member that presses a developing cartridge toward a photosensitive drum (image carrier).

According to an illustrative aspect of the present invention, there is provided a process cartridge that is detachably mounted to a main body of an image forming apparatus, the process cartridge comprising: an image carrier cartridge that has an image carrier on which an electrostatic latent image is formed; and a developing cartridge that has a developer carrier that is rotated so as to supply developer to the electrostatic latent image on the image carrier; and a press member that presses the developing cartridge toward the image carrier so as to depress the developer carrier to the image carrier, wherein the developing cartridge comprising: wherein a driving input part, to which external power for rotating the developer carrier is input, is provided to a first axial end side of the developer carrier of the developing cartridge; a first supported part; a second supported part; and a third supported part, wherein three support parts for supporting the developing cartridge by the image carrier cartridge are provide to the image carrier cartridge and the developing cartridge, and wherein the image carrier cartridge comprising: a first support part which supports the first supported part of the developing cartridge of the three support parts is, the first support part being arranged on a rotational axis line of the driving input part, when viewed from the above, under state in which the process cartridge is mounted to the main body; a second support part which supports the second supported part of the developing cartridge, the second support part is being arranged at an image carrier side rather than the rotational axis line of the driving input part; and a third support part which supports the third supported part of the developing cartridge, the third support part being is arranged at an opposite side to the second support part with the rotational axis line of the driving input part being interposed therebetween.

According to another aspect of the present invention, there is provided a developing cartridge comprising: a developer carrier that is rotated so as to supply developer; a driving input part, to which external power for rotating the developer carrier is input, is provided to a first axial end side of the developer carrier; a first supported part that is arranged on a rotational axis line of the driving input part when viewed from the above; a second supported part that is arranged at a first side with respect to the rotational axis line of the driving input part; and a third supported part that is arranged at an opposite side to the second supported part with the rotational axis line of the driving input part being interposed therebetween.

According to the invention, the first support part of the three support parts is scarcely affected by the moment. In addition, since the other two support parts are arranged one by one with the rotational axis line being interposed therebetween, it is easy to calculate the forces that will be applied to the two support parts. Accordingly, since it is possible to easily calculate the forces of the respective support parts, it is possible to easily set the pressing force of the press member.

According to the invention, it is possible to easily set the pressing force of the press member that presses the developing cartridge toward the image carrier.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

<Overall Configuration of Laser Printer>

Hereinafter, illustrative embodiments of the invention will be specifically described with reference to the drawings. In the meantime, an overall configuration of a laser printer, which is an example of an image forming apparatus, will be first described and characteristic parts of the invention will be then described in details.

In the below descriptions, directions will be described on the basis of a user who uses the laser printer. Namely, in FIG. 1, a left side of paper is referred to as "front side," a right side of paper is referred to as "back side (rear side)," an inside of paper is referred to as "left side" and a front side of paper is referred to as "right side." In addition, upper and lower directions of paper are referred to as "upper and lower directions."

Figure 1:
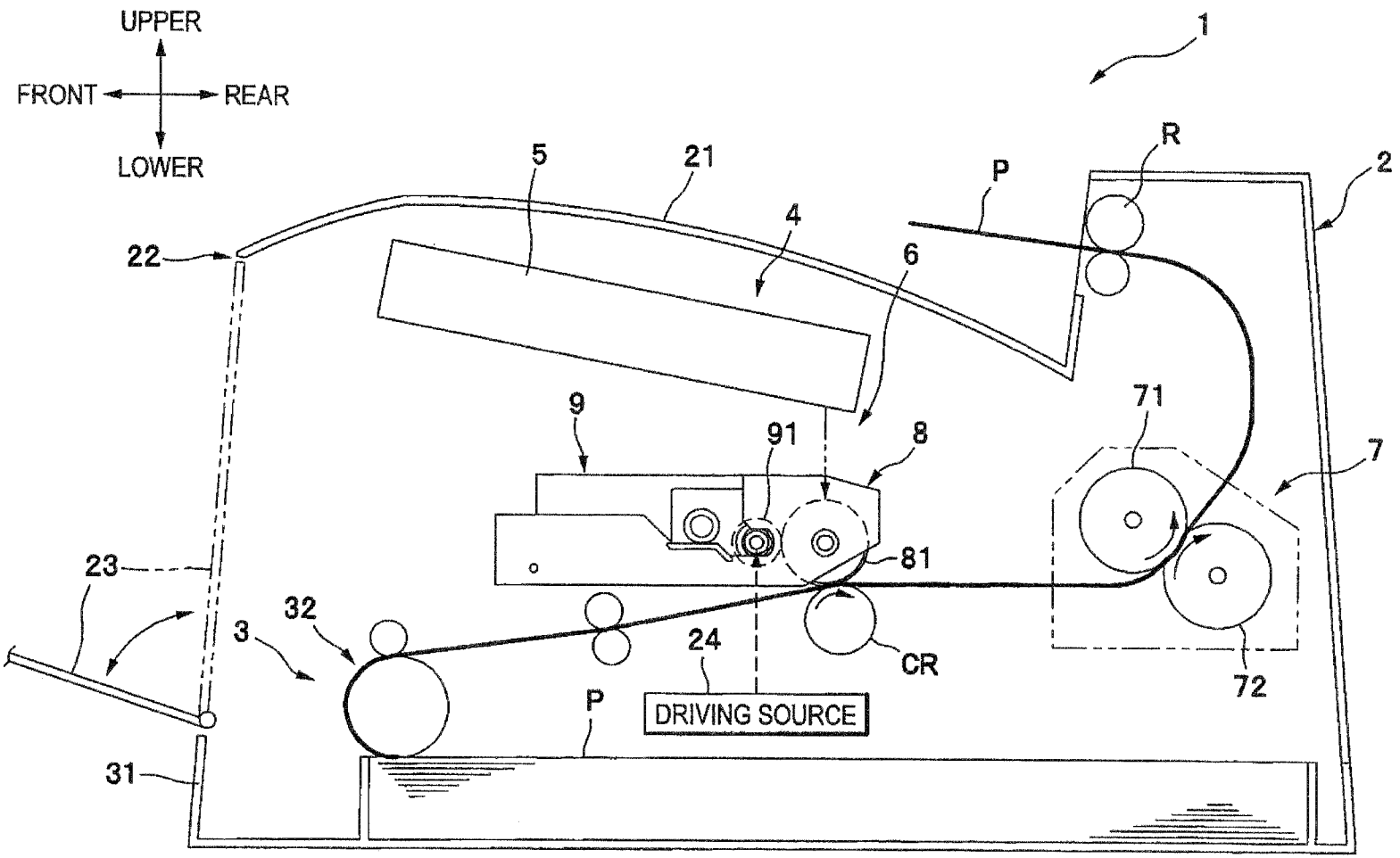
FIG. 1 illustrates a laser printer to which a process cartridge according to an illustrative embodiment of the invention is mounted.

As shown in FIG. 1, a laser printer 1 has a feeder unit 3 that feeds sheets P into a main body 2 and an image forming unit 4 that forms an image on the sheet P.

The feeder unit 3 has a sheet feeding tray 31 that is detachably mounted to a lower part of the main body 2 and a sheet feeding mechanism 32 that feeds sheets P in the feeder tray 31 toward the image forming unit 4.

The image forming unit 4 has a scanner unit 5, a process cartridge 6, a transfer roller CR, a photographic fixing device 7 and the like.

The scanner unit 5 is provided at an upper in the main body 2 and has a laser light emitting part, a polygon mirror, a lens, a reflector and the like, which are not shown. The scanner unit 5 scans laser beam on a surface of a photosensitive drum 81, which is an example of an image carrier, at high speed, which will be described later.

The process cartridge 6 has a drum cartridge 8 that is an example of an image carrier cartridge detachably mounted to the man body 2 and having the photosensitive drum 81, a developing roller 91 that is an example of a developer carrier and a developing cartridge 9 having toner that is an example of developer.

In the process cartridge 6, a surface of the rotating photosensitive drum 81 is uniformly charged by a charger (not shown) and then exposed to the laser beam of high speed from the scanner unit 5. Thereby, potential of the exposed part is lowered, so that an electrostatic latent image based on image data is formed on the surface of the photosensitive drum 81.

Then, toner in the developing cartridge 9 is supplied to the electrostatic latent image of the photosensitive drum 81 by the developing roller 91 being rotated, so that a toner image is formed on the surface of the photosensitive drum 81. After that, the sheet P is conveyed between the photosensitive drum 81 and the transfer roller CR, so that the toner image carried on the surface of the photosensitive drum 81 is transferred on the sheet P.

The photographic fixing device 7 has a heating roller 71 and a pressing roller 72 that is opposed to the heating roller 71 and presses the heating roller 71. In the photographic fixing device 7 configured as described above, the toner transferred on the sheet P is heat-fixed while the sheet P passes through between the heating roller 71 and the pressing roller 72.

In the meantime, the sheet P heat-fixed in the photographic fixing device 7 is conveyed to a sheet discharge roller R arranged downstream from the photographic fixing device 7 and is then discharged on a sheet discharge tray 21 from the sheet discharge roller R.

<Detailed Structures of Drum Cartridge 8 and Developing Cartridge 9>

Figure 2:
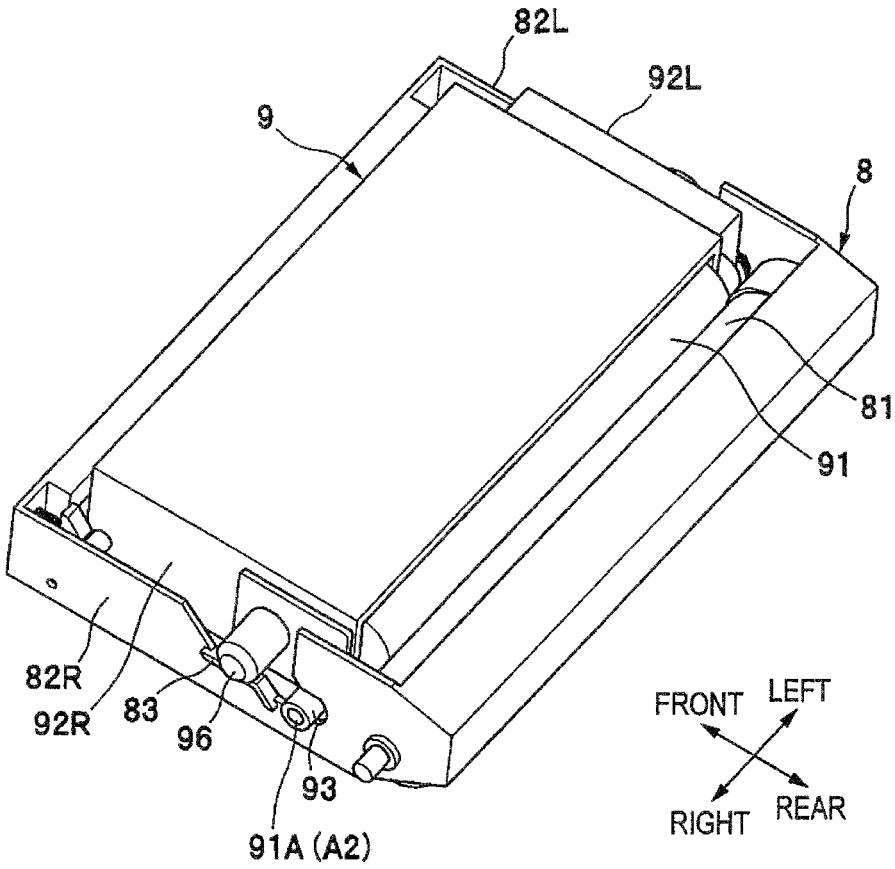
FIG. 2 is a perspective view of a process cartridge, which is viewed from an obliquely upward side.
Figure 3:
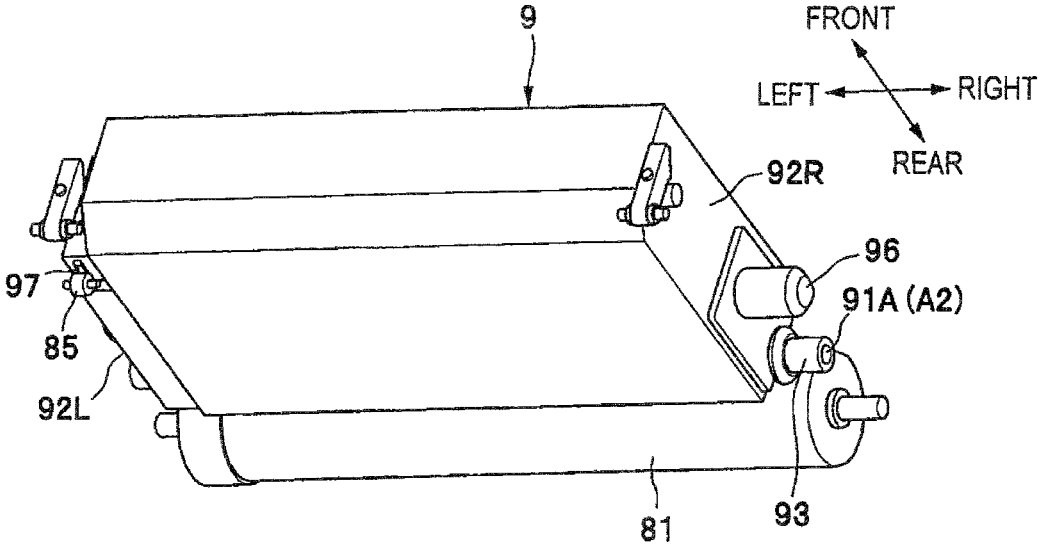
FIG. 3 is a perspective view of a developing cartridge, which is viewed from an obliquely downward right side together with a photosensitive drum.
Figure 4:
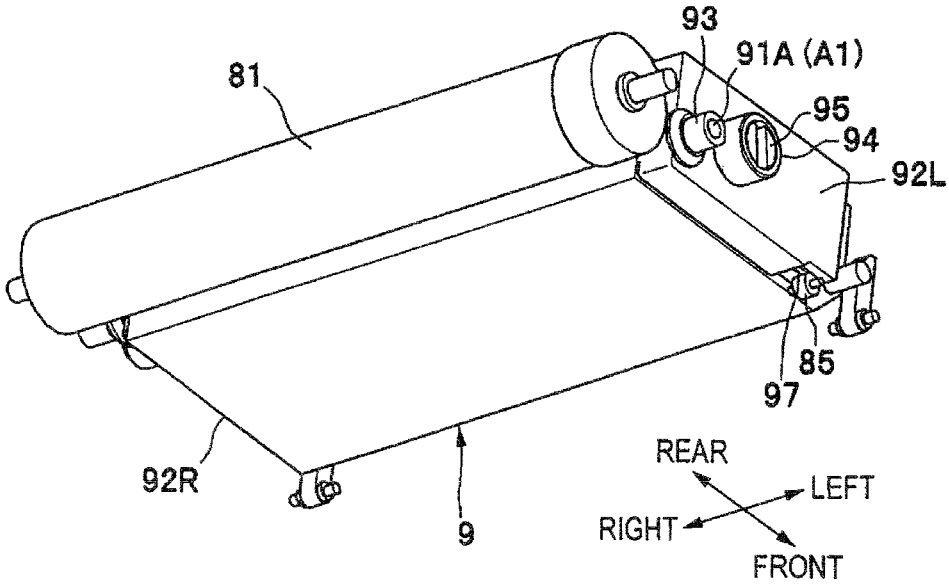
FIG. 4 is a perspective view of the developing cartridge, which is viewed from an obliquely downward left side together with the photosensitive drum.

As shown in FIG. 2, the developing cartridge 9 is detachably mounted to the drum cartridge 8 and has an agitator, a supply roller, a layer thickness regulation blade and the like, which are well known, in addition to the developing roller 91. As shown in FIGS. 3 and 4, a rotational shaft 91A of the developing roller 91 is provided in such a way that both end portions A1, A2 thereof protrude from left and right side faces 92L, 92R (both axial side faces of the developing roller 91). The end portions A1, A2 are arranged at a more backward position (photosensitive drum 81) than a rotational axis line L1 of an input member 95 that will be described later (refer to FIG. 5).

Meanwhile, for convenience' sake of explanations, FIGS. 3 and 4 appropriately show the respective members such as photosensitive drum 81 provided to the drum cartridge 8, in addition to the developing cartridge 9 detached from the drum cartridge 8.

Both end portions A1, A2 of the rotational shaft 91A are rotatably supported to bearings 93 that are provided to protrude from the respective side faces 92L, 92R. In this illustrative embodiment, the left end portion A1 of the rotational shaft 91A and the left bearing 93 configure a second support part, which is supported in a support recess 84 (refer to FIG. 7) of the drum cartridge 8, which will be described later.

As shown in FIG. 4, a cylindrical bearing part 94 that protrudes in a left-right outward direction is formed on the left side face 92L of the developing cartridge 9. An input member 95, which is an example of a driving input part to which external power for rotating the developing roller 91 is input, is rotatably provided in the bearing part 94. In the meantime, the external power is transferred from the driving source 24 such as motor provided to the main body 2 shown in FIG. 1 to a driving transfer part (not shown) via a gear and the like and is then transferred to the input member 95 from the driving transfer part. The driving transfer part and the input member 95 are connected by a universal joint, an orudam joint and the like and to thus transfer the driving force even when the developing cartridge 9 is slightly moved in the front-rear direction.

Figure 5:
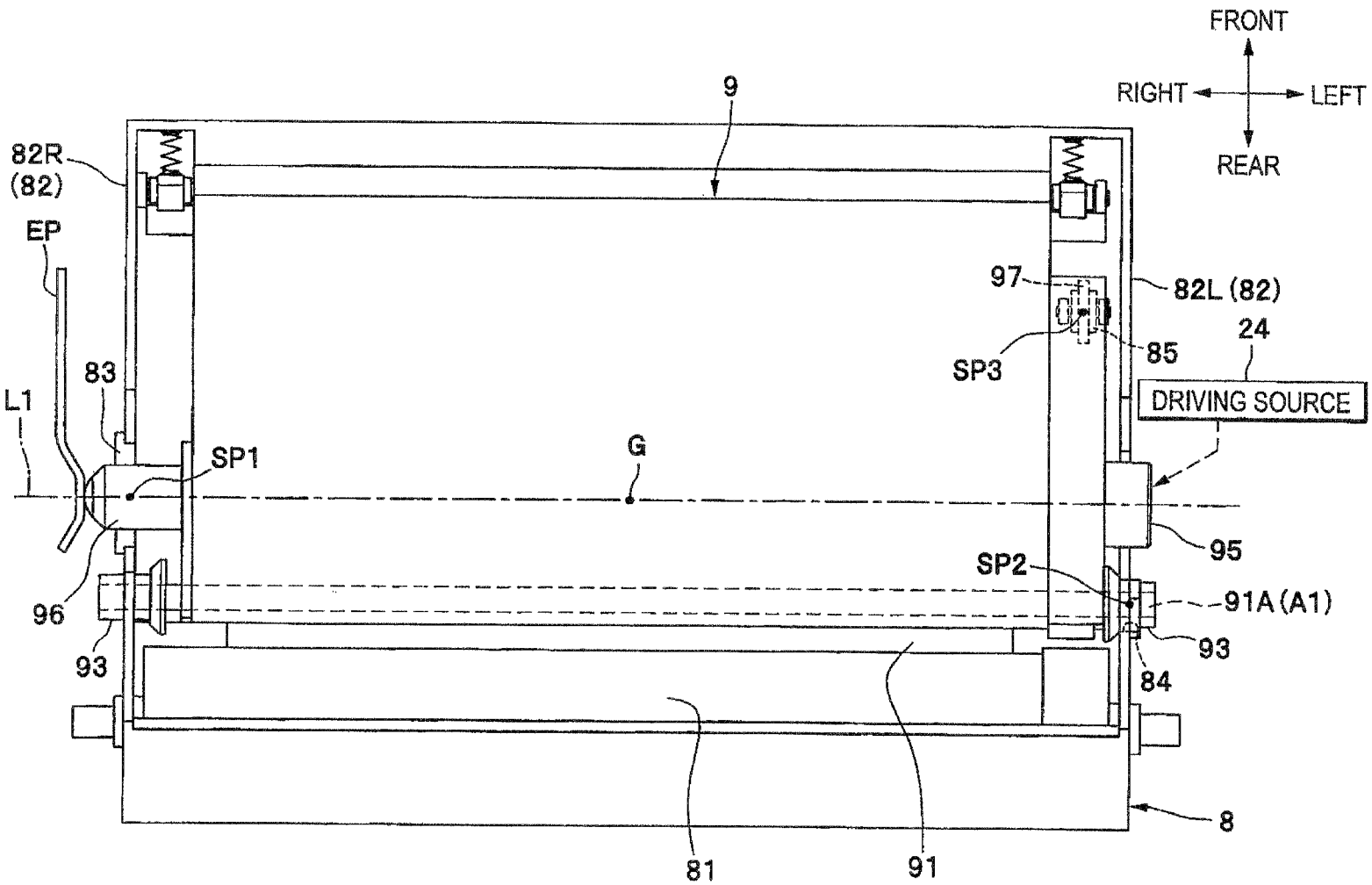
FIG. 5 is a plan view of the process cartridge.

In addition, as shown in FIG. 3, a boss part 96 protruding in a left-right outward direction, which is an example of a first support part, is formed on the right side face 92R of the developing cartridge 9. As shown in FIG. 5, the boss part 96 is a conducting part that contacts an external electrode EP provided to the main body 2 and thus applies bias to the developing roller 91 from the external electrode EP.

Under state in which the process cartridge 6 is mounted to the main body 2, the boss part 96 is arranged on the rotational axis line L (to be overlapped with the rotational axis line L1) of the input member 95, when seen from the above (from the vertically upper direction). The boss part 96 is supported to a support holder 83 of the drum cartridge 8, which will be described later.

In addition, as shown in FIG. 3, a rib 97 that is an example of a third support part is provided on a left-front portion of a lower surface of the developing cartridge 9. The rib 97 is supported by a roller 85 that will be described later. Specifically, as shown in FIG. 5, the rib 97 is arranged at a position that is opposite to the left end portion A1 of the rotational shaft 91A with the rotational axis line L1 being interposed therebetween and is the same side of the end portion A1 regarding the left-right direction (namely, a position that is left and opposite to the boss part 96 regarding the left-right direction).

Figure 6:
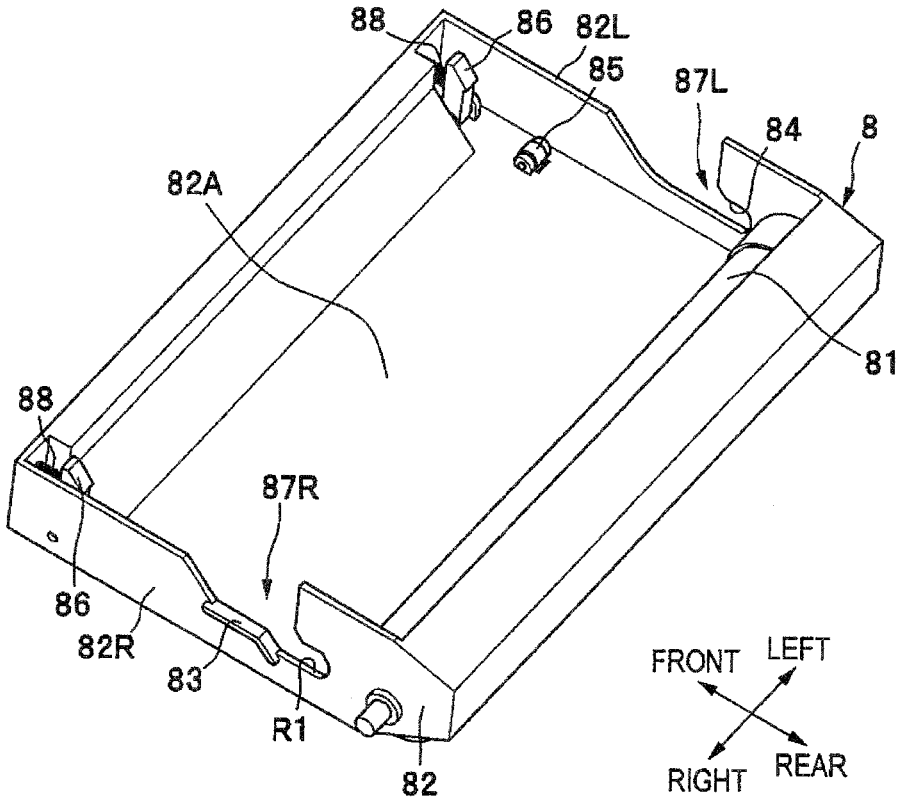
FIG. 6 is a perspective view of a drum cartridge.

As shown in FIG. 6, the drum cartridge 8 has the photosensitive drum 81, a known charger (not shown) and a box-shaped housing 82 that is upwardly opened. The housing 82 is provided with the support holder 83 that is an example of the first support part, the support recess 84 that is an example of the second support part and the roller 85 that is an example of the third support part and the developing cartridge 9 is three points-supported by the support parts.

As shown in FIG. 2, the support holder 83 is a part that supports the boss part 96 of the developing cartridge 9, and is formed so that it protrudes from a right sidewall 82R of the housing 82 in the left-right outward direction. As shown in FIG. 5, the support holder 83 is arranged on the rotational axis line L1 of the input member 95, when seen from the above, as the boss part 96.

Figure 7:
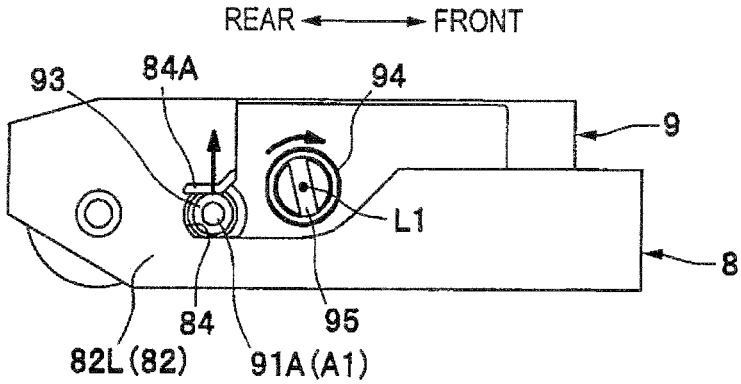
FIG. 7 is a left side view of the process cartridge.

As shown in FIG. 7, the support recess 84 is a U-shaped recess that is forwardly opened and formed on a left sidewall 82L of the housing 82, and supports the left end portion A1 of the rotational shaft 91A of the developing roller 91 via the left bearing 93. Although specifically described in the below, when the driving force is input to the input member 95 and moment is thus applied to the developing cartridge 9, an upper inner surface of the support recess suppresses, as shown, the end portion A1 of the rotational shaft 91 from moving upwardly. In addition, under state in which the driving force is not input to the input member 65, the end portion 91A tending to go down due to gravity is supported from the below on a lower inner surface of the support recess 84 via the left bearing 93.

In particular, a support rib 84A that conforms to the upper inner surface of the support recess 84 is formed at the upper part of the support recess 84 so that it protrudes in the left-right outward direction. Thereby, a wide surface is formed by the upper inner surface of the support recess 84 and the lower surface of the support rib 84A, so that when the moment is applied to the developing cartridge 9 as described above, it is possible to support the end portion 91A of the rotational shaft 91A by the wide surface.

In addition, as shown in FIG. 6, a left guidance recess 87L, which is an example of a guidance part that guides the left end portion A1 (specifically, bearing 93) of the rotational shaft 91A of the developing cartridge 9 to the mounting position (position shown in FIG. 7), is formed at a front side of the support recess 84. The left guidance recess 87L is gradually narrowed toward a downstream side (rearward and obliquely downward side) of the mounting direction of the developing cartridge 9 to the drum cartridge 8 and is formed to continue to the support recess 84. In addition, when the developing cartridge 9 is mounted to the drum cartridge 8, the left guidance recess 87L is arranged with a gap with the input member 95 (specifically, bearing part 94), as shown in FIG. 7.

Figure 8:
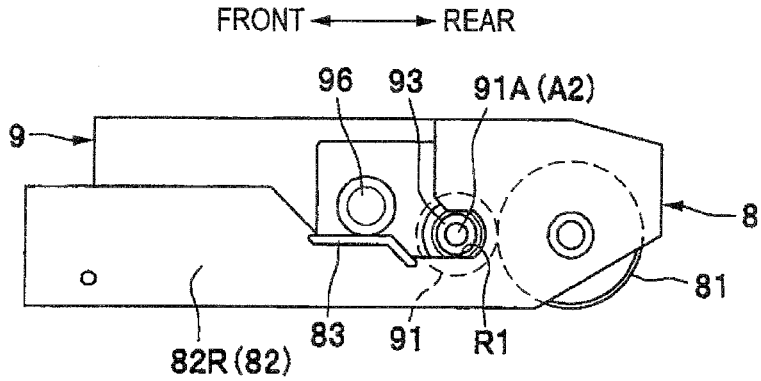
FIG. 8 is a right side view of the process cartridge.

Furthermore, a right guidance recess 87R, which is an example of a guidance part that guides the right end portion A2 (specifically, bearing 93) of the rotational shaft 91A of the developing cartridge 9 to the mounting position, is formed on the right sidewall 82R of the housing 82. The right guidance recess 87R has such a shape that is obtained by combining the left guidance recess 87L and the support recess 84. A part R1 of the right guidance recess corresponding to the support recess 84 is formed to be wider (to be long in the upper-lower direction) than the support recess 84. Accordingly, as shown in FIG. 8, when the developing cartridge 9 is mounted to the drum cartridge 8, the part R1 is arranged with a vertical gap with the right end portion A2 (specifically, bearing 93) of the rotational shaft 91A.

As shown in FIG. 6, the support holder 83 is formed in such a way that the upper surface thereof conforms to a guidance surface of a part of the right guidance recess 87R. Therefore, as shown in FIG. 2, when the developing cartridge 9 is mounted to the drum cartridge 8, it is possible to support the right end portion A2 of the rotational shaft 91A of the developing cartridge 9 from the below by the wide surface formed by the part of the inner surface of the right guidance recess 87R and the upper surface of the support holder 83.

Figure 9:
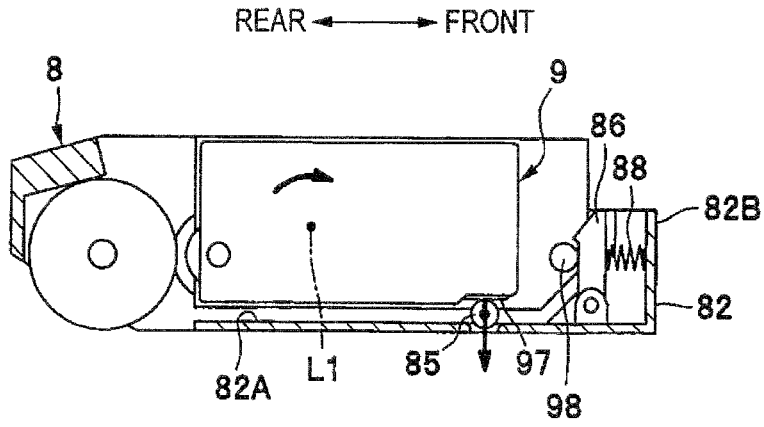
FIG. 9 is a sectional view of the process cartridge including a roller.

As shown in FIGS. 6 and 9, the roller 85 is provided at a left-front position of a lower surface 82A of the housing 82 so that it can rotate forward and rearward, and supports the developing cartridge 9 so that the developing cartridge can move forward and rearward. Since the roller 85 supports the developing cartridge 9 so that the developing cartridge can move forward and rearward, even when the driving force is input to the input member 95 and the photosensitive drum 81 and the developing roller 91 are thus shaken, it is possible to keep a state in which the developing roller 91 and the photosensitive drum 81 are contacted with constant load. Specifically, as shown in FIG. 5, the roller 85 is arranged at a more forward position (an opposite side to the support recess 84 with the rotational axis line L1 being interposed therebetween) than the rotational axis line L1 of the input member 95 of the developing cartridge 9 mounted to the drum cartridge 8.

A center of gravity G of the developing cartridge 9, which is three points-supported by the drum cartridge 8, is positioned on the rotational axis line L1 of the input member 95 (an overlapped position with the rotational axis line L1 when seen from the above). Thereby, it is possible to support the developing cartridge 9 with well balanced by the three support points SP1 to SP3 (the support holder 83, the support recess 84 and the roller 85) of the drum cartridge 8.

In the meantime, the position of the center of gravity G of the developing cartridge 9 is changed as toner in the developing cartridge 9 is consumed. However, since a ratio of a toner weight to a weight of the developing cartridge 9 is not high, the center position is not highly changed even when the toner weight is changed. In addition, the position of the center of gravity G of the developing cartridge 9 is not limited to the above position. For example, the position of the center of gravity G of the developing cartridge 9 may be arranged in a triangular area formed by the three support points SP1 to SP3 of the drum cartridge 8.

In addition, as shown in FIG. 6, the photosensitive drum 81 is rotatably supported to a back side part of the housing 82 and a press member 86 that presses the developing cartridge 9 toward the photosensitive drum 81 so as to depress the developing roller 91 to the photosensitive drum 81 is provided at a front side part of the housing.

Specifically, as shown in FIG. 9, the press member 86 is swingably provided to the housing 82 and is always pressed rearward by a coil spring 88 that is fixed on a rear wall 82B of the housing 82. The press member 86 presses the developing cartridge 9 toward the photosensitive drum 81 by pushing a projection 98 provided at a front part of the left-right sidewall of the developing cartridge 9.

Figure 13:
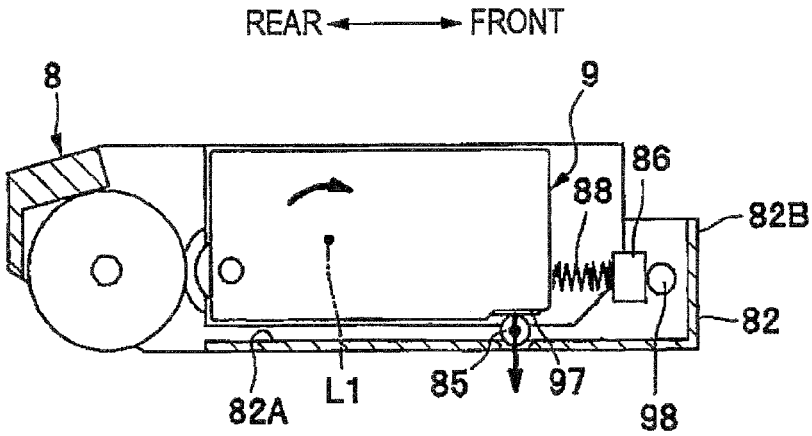
FIG. 13 is a sectional view of the process cartridge according to a modified embodiment.

However, as shown in FIG. 13, the press member 86 and the coil spring 88 can be provided on a part of the housing of the developing cartridge 9. In addition, the projection 98 can be provided on the housing 82.

Next, the forces will be described which are applied to the respective support points SP1 to SP3 when the driving force is input to the input member 95.

As shown in FIG. 7, when the driving force (moment) is input to the input member 95 in a clockwise direction of FIG. 7, upward force is applied to the support recess 84 that is located at a more rearward position than the rotational axis line L1, and downward force is applied to the roller 85 that is located at a more forward position than the rotational axis line L1, as shown in FIG. 9.

At this time, as shown in FIG. 5, the moment applied to the input member 95 is scarcely applied to the support holder 83 on the rotational axis line L1. Accordingly, since it is not necessary to consider the force that is applied to the support holder 83, it is possible to simply calculate the forces that are applied to the two points of the support recess 84 and the roller 85.

According to the invention, following effects can be obtained.

Since it is possible to simply calculate the forces that are applied to the two points of the support recess 84 and the roller 85, it is possible to easily set the pressing force of the press member 86 (coil spring 88).

Since the support recess 84 and the roller 85 are provided on the same side as the input member 95 regarding the left-right direction, it is possible to bear the moment applied to the input member 95 by the support recess 84 and the roller 85 provided on the same side (position near to the input member 95 with respect to the left-right direction) as the input member 95, so that it is possible to suppress the distortion of the developing cartridge 9.

Since the boss part 96 serving as the first support part is used as a conducting part contacting the external electrode EP, it is possible to make the parts common and to thus reduce the costs, compared to a structure in which a conducting part is separately provided from the boss part (first support part).

The right end portion A2 of both end portions A1, A2 of the rotational shaft 91A, which is not supported by the drum cartridge 8, is guided to the mounting position by the guidance recesses 87R, 87L together with the supported left end portion A1, so that it is possible to improve the operability, compared to a structure in which only the left end portion A1 is guided.

Since the position of the center of gravity of the developing cartridge 9 is located on the rotational axis line L1 of the input member 95, it is possible to support the developing cartridge 9 with well balanced by the drum cartridge 8.

In the meantime, the invention is not limited to the above illustrative embodiment and can be variously used as described below.

Figure 10:
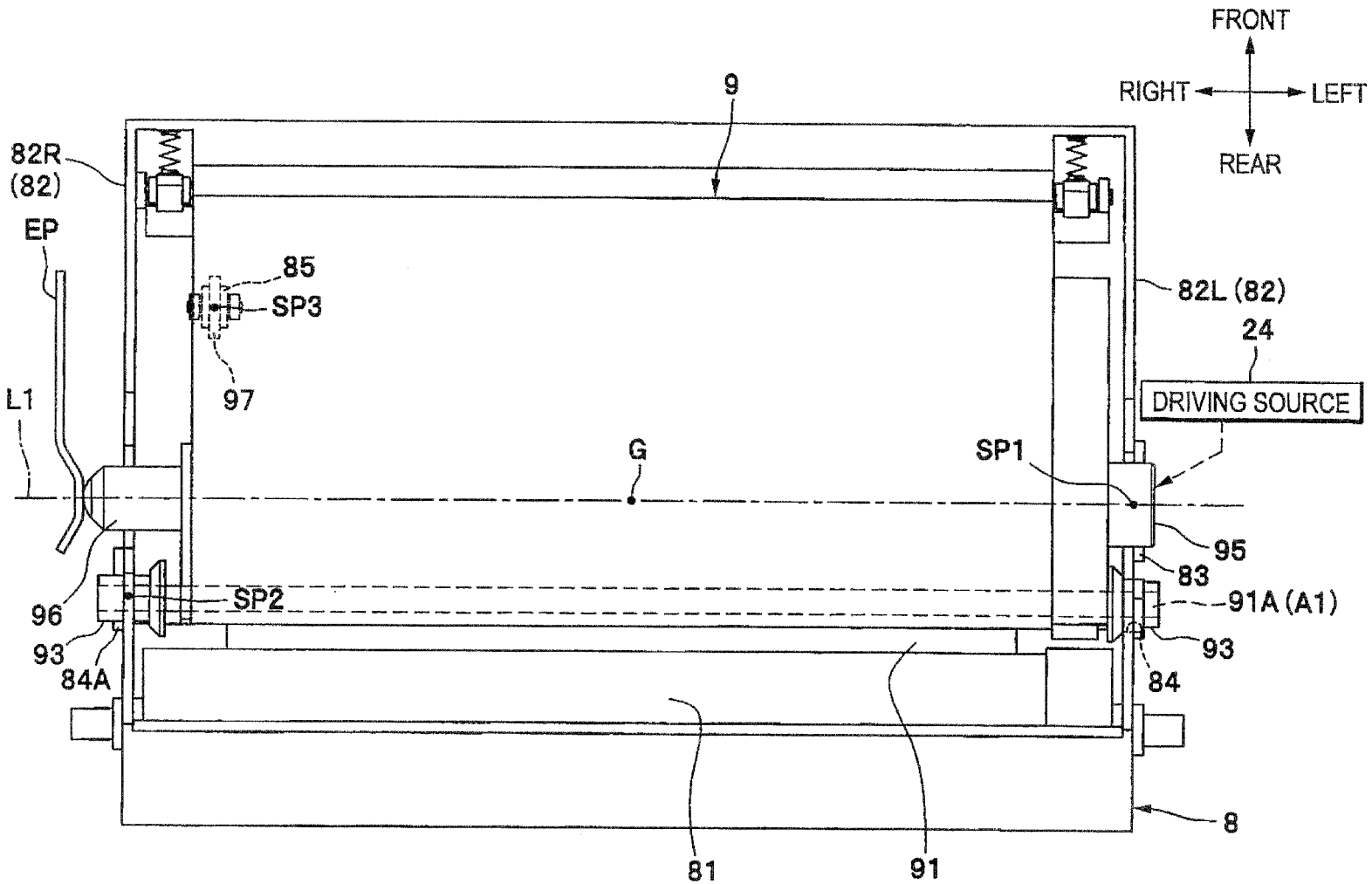
FIG. 10 is a plan view showing a modified embodiment of an arrangement of respective support parts.
Figure 11:
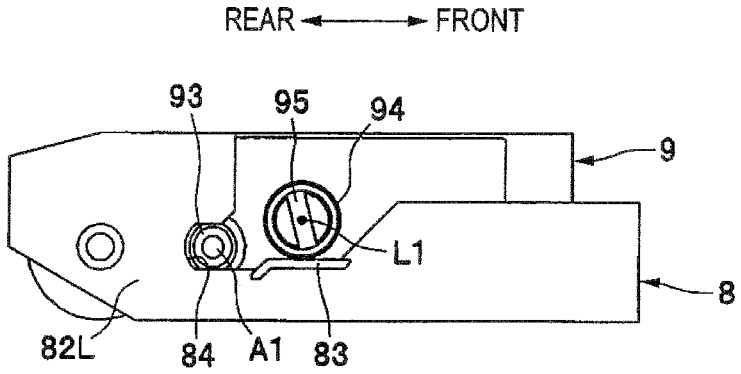
FIG. 11 is a left side view of a process cartridge shown in FIG. 10.
Figure 12:
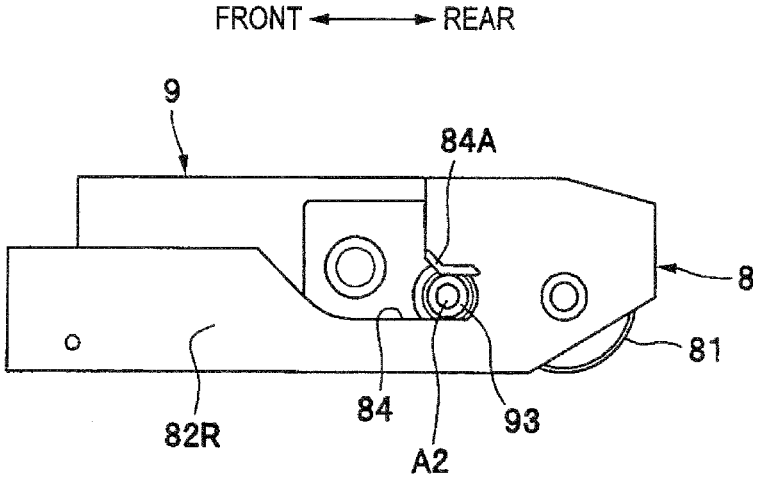
FIG. 12 is a right side view of the process cartridge shown in FIG. 10.

In the above illustrative embodiment, the first support part (boss part 96, support holder 83) is provided at the opposite side to the input member 95 with respect to the left-right direction and the second support part (end portion A1, bearing 93 and support recess 84) and the third support part (rib 97, roller 85) are provided at the same side as the input member 95 with respect to the left-right direction. However, the invention is not limited thereto. For example, as shown in FIGS. 10 to 12, contrary to the above illustrative embodiment, the first support part (support point SP1) may be provided at the same side as the input member 95 with respect to the left-right direction and the second support part and the third support part (support points SP2, SP3) may be provided at the opposite side to the input member 95 with respect to the left-right direction. In FIGS. 10 to 12, the substantially same structures as the above illustrative embodiment are indicated with the same reference numerals and the explanations thereof are omitted.

In this case, as shown in FIG. 11, the first support part of the developing cartridge 9 is the bearing part 94 and the support holder 83 that supports the bearing part 94 is provided as the first support part on the left sidewall 82L of the drum cartridge 8. In addition, as shown in FIG. 12, the second support part of the developing cartridge 9 is the right end portion A2 (bearing 93) of the rotational shaft 91A of the developing roller 91 and the support recess 84 and the support rib 84A that support the right end portion A2 (bearing 93) are provided as the second support part on the right sidewall 82R of the drum cartridge 8.

In addition, as shown in FIG. 10, the rib 97 and the roller 85, which serve as the third support part, are arranged at the right-front side of the developing cartridge 9 and the drum cartridge 8. Also in this structure, since it is possible to simply calculate the forces that are applied to the two points of the support points SP2, SP3, like the above illustrative embodiment, it is possible to easily set the pressing force of the press member 86 (coil spring 88).

In the above illustrative embodiment, the photosensitive drum 81 is adopted as the image carrier. However, the invention is not limited thereto. For example, a belt-type photosensitive body may be adopted. In addition, the press member may be configured by a plate spring or torsion spring only. Furthermore, the shapes and configurations of the respective support parts or guidance parts may be appropriately changed. For example, the roller 85 may be replaced with a member that is not rotatable.

In the above illustrative embodiment, the developing cartridge 9 having integrated the toner accommodation part that accommodates toner is adopted. However, the invention is not limited thereto. For example, the invention may be applied to a developing cartridge having a detachable toner accommodation part that accommodates toner.

In the above illustrative embodiment, the laser printer 1 is exemplified as the image forming apparatus. However, the invention is not limited thereto. For example, an LED printer that performs an exposure by an LED, a copier, a complex device and the like may be also possible. In addition, in the above illustrative embodiment, the image forming apparatus that forms a black-white image is exemplified. However, the invention is not limited thereto. For example, an image forming apparatus that forms a color image may be possible.

What is claimed is:

1. A process cartridge that is detachably mounted to a main body of an image forming apparatus, the process cartridge comprising:

an image carrier cartridge that has an image carrier on which an electrostatic latent image is formed; and a developing cartridge that has a developer carrier that is rotated so as to supply developer to the image carrier;

wherein the developing cartridge comprises:

a driving input part, to which external power for rotating the developer carrier is input, provided to a first axial end side of the developer carrier;

a first supported part;

a second supported part; and a third supported part, wherein the image carrier cartridge comprises:

a first support part which supports the first supported part of the developing cartridge, wherein the first support part is arranged on a rotational axis line of the driving input part, when viewed from above, under a state in which the process cartridge is mounted to the main body, and wherein the first support part has a support surface extending in parallel to the rotational axis line of the driving input part and the support surface supports the first supported part in a perpendicular direction to the rotational axis line of the driving input part;

a second support part which supports the second supported part of the developing cartridge, the second support part being arranged on an image carrier side of the rotational axis line of the driving input part; and a third support part which supports the third supported part of the developing cartridge, the third support part being arranged at an opposite side to the second support part relative to the rotational axis line of the driving input part, which is interposed therebetween, wherein the first support part, the second support part, and the third support part support the first supported part, the second supported part, and the third supported part, respectively, such that a center of gravity of the developing cartridge is arranged in a triangular area defined by the first support part, the second support part, and the third support part.

2. The process cartridge according to claim 1, wherein the image carrier cartridge has a press member that presses the developing cartridge towards the image carrier.

3. The process cartridge according to claim 2, wherein the press member has a first press member that is configured to press a portion of the developing cartridge which is close to the first axial end side of the developer carrier and a second press member that is configured to press a portion of the developing cartridge which is close to a second axial end side that is opposite to the first axial end side of the developer carrier.

4. The process cartridge according to claim 1, wherein the developing cartridge has a press member that presses the developing cartridge toward the image carrier.

5. The process cartridge according to claim 1, wherein the first support part is arranged at a second axial end side that is opposite to the first axial end side of the developer carrier, and wherein both the second support part and the third support part are arranged at the first axial end side.

6. The process cartridge according to claim 5, wherein the first supported part of the developing cartridge is a boss part that protrudes from a surface of the second axial end side of the developer carrier.

7. The process cartridge according to claim 6, wherein the boss part is a conducting part that contacts an external electrode and thus applies bias to the developing cartridge from the external electrode.

8. The process cartridge according to claim 5, wherein the developing cartridge is configured so that it is detachably mounted to the image carrier cartridge, wherein the developer carrier has a rotational shaft, the rotational shaft comprising a first end portion and a second end portion that is opposite to the first end portion, the first end portion and the second end portion protrude from both side faces of the developing cartridge, and the first end portion is the second supported part, wherein the image carrier cartridge has a guidance part, the guidance part guides the first end portion and the second end portion of the rotational shaft so as to arrange the developing cartridge to a mounting position of the image carrier cartridge, and wherein a portion of the guidance part that guides the second end portion of the rotational shaft is arranged with a gap with the second end portion when the developing cartridge is mounted to the image carrier cartridge.

9. The process cartridge according to claim 1, wherein the center of gravity of the developing cartridge is located on the rotational axis line of the driving input part.

10. The process cartridge according to claim 1, wherein the first support part is arranged at the first axial end side of the developer carrier, and wherein both the second support part and the third support part are arranged at a second axial end side that is opposite to the first axial end side of the developer carrier.

11. A developing cartridge comprising:

a developer carrier that is rotated so as to supply developer;

a driving input part, to which external power for rotating the developer carrier is input, provided to a first axial end side of the developer carrier;

a first supported part that is arranged on a rotational axis line of the driving input part when viewed from above, wherein the first supported part is configured to be supported by a support surface of a first support part of an image carrier cartridge, the support surface extending in parallel to the rotational axis line of the driving input part, and wherein the first supported part is configured to be supported by the support surface in a perpendicular direction to the rotational axis line of the driving input part;

a second supported part configured to a supported by a second support part of the image carrier cartridge, wherein the second supported part is arranged at a first side with respect to the rotational axis line of the driving input part; and a third supported part configured to be supported by a third support part of the image carrier cartridge, wherein the third supported part is arranged at an opposite side to the second supported part relative to the rotational axis line of the driving input part, which is interposed therebetween, wherein the first supported part, the second supported part, and the third supported part are configured to be supported by the first support part, the second support part, and the third support part, respectively, such that a center of gravity of the developing cartridge is arranged in a triangular area defined by the first support part, the second support part, and the third support part.

12. The developing cartridge according to claim 11, further comprising a press member that press the developing cartridge toward an image carrier of an image carrier cartridge.

13. The developing cartridge according to claim 12, wherein the press member has a first press member that is configured to press a portion of the developing cartridge which is close to the first axial end side of the developer carrier and a second press member that is configured to press a portion of the developing cartridge which is close to a second axial end side that is opposite to the first axial end side of the developer carrier.

14. The developing cartridge according to claim 11, wherein the first supported part is a boss part that protrudes from a surface of the second axial end side that is opposite to the first axial end side of the developer carrier.

15. The developing cartridge according to claim 14, wherein the boss part is a conducting part that contacts an external electrode and thus applies bias to the developing cartridge from the external electrode.

16. The developing cartridge according to claim 11, wherein the center of gravity of the developing cartridge is located on the rotational axis line of the driving input part.

* * * * *